US007517305B2

(12) United States Patent
Lien

(10) Patent No.: US 7,517,305 B2
(45) **Date of Patent: *Apr. 14, 2009**

(54) WEIGHT PLATE FOR INTERLOCKING AND WEIGHT ADJUSTMENT

(75) Inventor: Louis Lien, Bellaire, TX (US)

(73) Assignee: USA Sports, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/684,231

(22) Filed: Mar. 9, 2007

(65) Prior Publication Data

US 2007/0155593 A1 Jul. 5, 2007

Related U.S. Application Data

(63) Continuation of application No. 11/083,426, filed on Mar. 18, 2005, now Pat. No. 7,198,591.

(51) Int. Cl.
*A63B 21/072* (2006.01)
*A63B 21/06* (2006.01)

(52) U.S. Cl. ..... 482/106; 482/93

(58) Field of Classification Search ..... 482/106–108, 482/93; D21/680, 681; 492/39, 40, 45
See application file for complete search history.

(56) References Cited

U.S. PATENT DOCUMENTS 776,796 A * 12/1904 Perkins ..... 492/40
1,047,212 A 12/1912 Hamilton
2,244,351 A 6/1941 Venables
2,447,218 A 8/1948 Trzesniewski
2,676,802 A 4/1954 O'Brien
2,773,300 A * 12/1956 Clements ..... 492/16
2,796,269 A 6/1957 Watson
D194,042 S * 11/1962 Guthormsen ..... D21/681
3,171,652 A 3/1965 Newman
3,226,117 A 12/1965 Walklet (Continued)

OTHER PUBLICATIONS

USA Sports, Inc., "VTX Grip Plate Casting Details," dated Jun. 12, 2001, 2-pages.

(Continued)

*Primary Examiner*—Loan H Thanh
*Assistant Examiner*—Allana Lewin
(74) *Attorney, Agent, or Firm*—Wong, Cabello, Lutsch, Rutherford & Brucculeri, LLP

(57) ABSTRACT

A weight plate have integrally formed handles is provided. The weight plate has a weight plate body having an outer periphery, a first side, and a second side that is substantially flat. The weight plate also has a central bore extending through the body, a raised flange member forming a portion of the outer periphery on the first side, and at least one handle opening extending through the body and through ht least a portion of the outer periphery. The handle formed by each handle opening, the corresponding recess, and the raised flange member is sufficient for a human hand to grip. In one embodiment, the weight plate further includes an interlock for interlocking the weight plate with another weight plate when positioned together. In another embodiment, the weight plate further includes a pock defined in the weight plate. The pock allows the weight of the weight plate to be adjusted to a desired weight by allowing additional material to be added to the pock.

23 Claims, 5 Drawing Sheets

U.S. PATENT DOCUMENTS

| | | | | | |
|---|---|---|---|---|---|
| 3,482,835 | A | | 12/1969 | Dean | |
| D216,517 | S | | 1/1970 | Dorn | |
| 3,572,702 | A | | 3/1971 | Dorn | |
| 3,771,785 | A | | 11/1973 | Speyer | |
| 3,796,431 | A | | 3/1974 | Sinyard | |
| 3,913,908 | A | * | 10/1975 | Speyer | 482/106 |
| 3,971,555 | A | | 7/1976 | Mahnke | |
| 4,079,932 | A | | 3/1978 | Schuetz | |
| 4,231,569 | A | | 11/1980 | Rae | |
| 4,311,306 | A | | 1/1982 | Solloway | |
| 4,369,968 | A | | 1/1983 | Price | |
| 4,373,717 | A | | 2/1983 | Lambert, Jr. | |
| D274,283 | S | | 6/1984 | Wright | |
| 4,455,020 | A | | 6/1984 | Schnell | |
| 4,482,151 | A | | 11/1984 | Zwilling | |
| D278,358 | S | | 4/1985 | Zwilling | |
| 4,515,364 | A | | 5/1985 | Rotella | |
| 4,625,959 | A | | 12/1986 | Schleffendorf | |
| 4,673,179 | A | | 6/1987 | Pengler | |
| 4,756,526 | A | | 7/1988 | Broussard | |
| 4,817,944 | A | | 4/1989 | Anderson et al. | |
| 4,828,256 | A | | 5/1989 | Lee | |
| 4,854,575 | A | | 8/1989 | Wilson et al. | |
| 4,872,247 | A | * | 10/1989 | Nakamura et al. | 492/40 |
| 4,880,229 | A | | 11/1989 | Broussard | |
| D309,763 | S | | 8/1990 | Solloway | |
| 5,137,502 | A | | 8/1992 | Anastasi | |
| 5,344,375 | A | | 9/1994 | Cooper | |
| D355,007 | S | | 1/1995 | Rojas et al. | |
| 5,407,413 | A | * | 4/1995 | Kupferman | 482/106 |
| 5,464,379 | A | | 11/1995 | Zarecky | |
| 5,573,484 | A | | 11/1996 | Carpenter | |
| D377,202 | S | | 1/1997 | Rohan | |
| 5,735,777 | A | * | 4/1998 | Benoit et al. | 482/93 |
| D394,685 | S | | 5/1998 | Eckmann | |
| 5,853,355 | A | | 12/1998 | Standish | |
| D405,484 | S | | 2/1999 | Rojas et al. | |
| D406,183 | S | | 2/1999 | Zovich | |
| D409,266 | S | | 5/1999 | Rojas et al. | |
| D421,076 | S | | 2/2000 | Lincir | |
| D424,639 | S | | 5/2000 | Rojas et al. | |
| D428,947 | S | | 8/2000 | Harms et al. | |
| D433,721 | S | | 11/2000 | Rojas et al. | |
| D434,090 | S | | 11/2000 | Wallace et al. | |
| D445,854 | S | | 7/2001 | Harms et al. | |
| D448,055 | S | | 9/2001 | Lien et al. | |
| D450,361 | S | | 11/2001 | Harms et al. | |
| 6,319,176 | B1 | | 11/2001 | Landfair | |
| 6,328,678 | B1 | * | 12/2001 | Romero | 482/106 |
| 6,436,015 | B1 | | 8/2002 | Frasco et al. | |
| 6,746,380 | B2 | | 6/2004 | Lien et al. | |
| D516,639 | S | * | 3/2006 | Hamilton | D21/681 |
| 7,198,591 | B2 | * | 4/2007 | Lien | 482/106 |
| 2006/0003874 | A1 | * | 1/2006 | Hamilton | 482/93 |
| 2007/0135271 | A1 | * | 6/2007 | Lien et al. | 482/93 |

OTHER PUBLICATIONS

"New Troy Interlocking Plates," advertisement appearing in Club Industry magazine Jan. 2001, undated, 1-page.

Troy, "GO-45V," obtained from http://www.usasportsinc.com/..., generated on Mar. 18, 2005, 1-page.

Troy, "GO-45V-s," obtained from http://www.usasportsinc.com/..., generated on Mar. 18, 2005, 1-page.

Troy, "5-lb Training Plate," obtained from http://www.usasportsinc.com/..., generated on Mar. 18, 2005, 1-page.http://.

Troy, "10-lb Training Plate," obtained from http://www.usasportsinc.com/..., generated on Mar. 18, 2005, 1-page.

Troy, "Bumper Plate," obtained from http://www.usasportsinc.com/..., generated on Mar. 18, 2005, 1-page.

Troy, "Wide Flanged Plate," obtained from http://www.usasportsinc.com/..., generated on Mar. 18, 2005, 1-page.

Troy, "Black Regular Plate," obtained from http://www.usasportsinc.com/..., generated on Mar. 18, 2005, 1-page.

Troy, "Rubber Encased Olympic Plate," obtained from http://www.usasportsinc.com/..., generated on Mar. 18, 2005, 1-pages.

Troy, "Gray Olympic Plate," obtained from http://www.usasportsinc.com/..., generated on Mar. 18, 2005, 1-page.

Troy, "Gray Regular Plate," obtained from http://www.usasportsinc.com/..., generated on Mar. 18, 2005, 1-page.

Troy, "Wide Flanged PO Plate," obtained from http://www.usasportsinc.com/..., generated on Mar. 18, 2005, 1-page.

Troy, "Rubber Encased-Quiet Iron Plate," obtained from http://www.usasportsinc.com/..., generated on Mar. 18, 2005, 1-page.

Troy, "Black Olympic Plate," obtained from http://www.usasportsinc.com/..., generated on Mar. 18, 2005, 1-page.

Ivanko, "Barbell Company Weightlifting Equipment Online," obtained from http://www.ivanko.com/..., generated on Mar. 18, 2005, 1-page.

Ivanko, "CBPP—Olympic Calibrated Competition Painted Powerlifting Disc—The only I.P.F. approved plate in the Western Hemisphere," obtained from http://www.ivanko.com/..., generated on Mar. 18, 2005, 2-pages.

Ivanko, "Plates," obtained from http://www.ivanko.com/..., generated on Mar. 18, 2005, 2-pages.

Ivanko, "OMC—Olympic Machined Chrome Plates," obtained from http://www.ivanko.com/..., generated on Mar. 18, 2005, 1-pages.

Ivanko, "OM—Olympic Machined Hammertone Grey Plate," obtained from http://www.ivanko.com/..., generated on Mar. 18, 2005, 2-pages.

Ivanko, "OCB—Olympic Calibrated Competition Weightlifting Disc—Finally! Quality bumper plates priced affordably," obtained from http://www.ivanko.com/..., generated on Mar. 18, 2005, 2-pages.

Ivanko, "OBP—Olympic Bumper Plate—Bumper plates for lifters on a budget!," obtained from http://www.ivanko.com/..., generated on Mar. 18, 2005, 1-page.

Ivanko, "CBP—Olympic Calibrated Competition Chrome Powerlifting Disc—The only I.P.F. approved plate in the Western Hemisphere," obtained from http://www.ivanko.com/..., generated on Mar. 18, 2005, 2-pages.

Ivanko, "CBPP—Olympic Calibrated Competition Painted Powerlifting Disc—The only I.P.F. approved plate in the Wester Hemisphere," obtained from http://www.ivanko.com/..., generated on Mar. 18, 2005, 2-pages.

Ivanko, "O2B—Economy Black Painted Olympic Plate," obtained from http://www.ivanko.com/..., generated on Mar. 18, 2005, 2-pages.

Ivanko, "O—Olympic Non-Machined Hammertone Grey Plate," obtained from http://www.ivanko.com/..., generated on Mar. 18, 2005, 2-pages.

Ivanko, "RMC—Regular Machined Cast Iron Chrome Plate," obtained from http://www.ivanko.com/..., generated on Mar. 18, 2005, 2-pages.

Ivanko, "RUB—Standard Rubber Encased Plate," obtained from http://www.ivanko.com/..., generated on Mar. 18, 2005, 2-pages.

Ivanko, "RM—Regular Machined Grey Plate," obtained from http://www.ivanko.com/..., generated on Mar. 18, 2005, 2-pages.

Ivanko, "R2B—Economy Cast Iron Black Painted Regular Plate," obtained from http://www.ivanko.com/..., generated on Mar. 18, 2005, 2-pages.

Ivanko, "R—Non-Machined Regular Machined Grey Plate," obtained from http://www.ivanko.com/..., generated on Mar. 18, 2005, 2-pages.

* cited by examiner

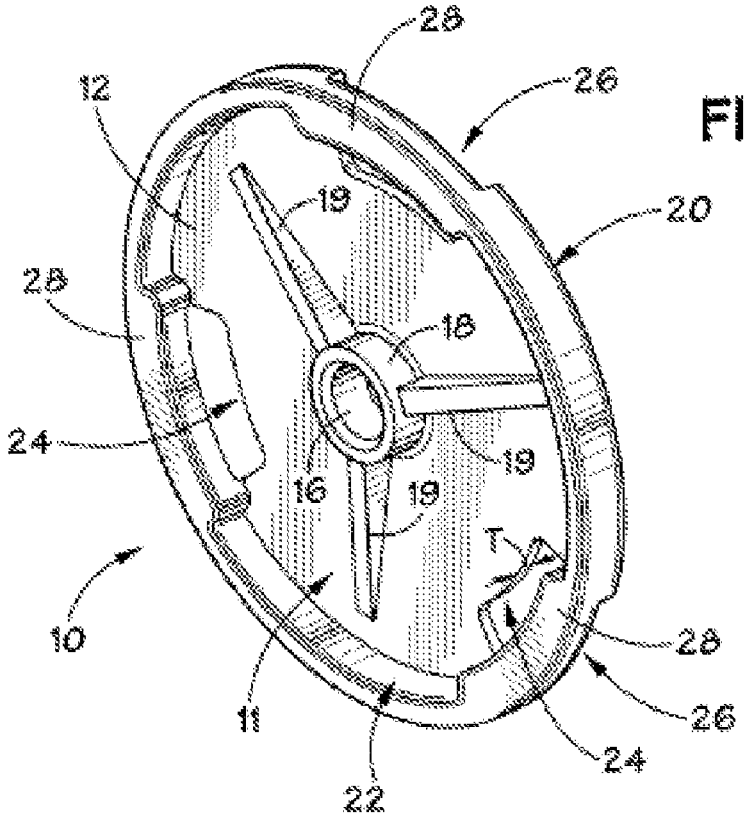
FIG. 1
FIG. 2
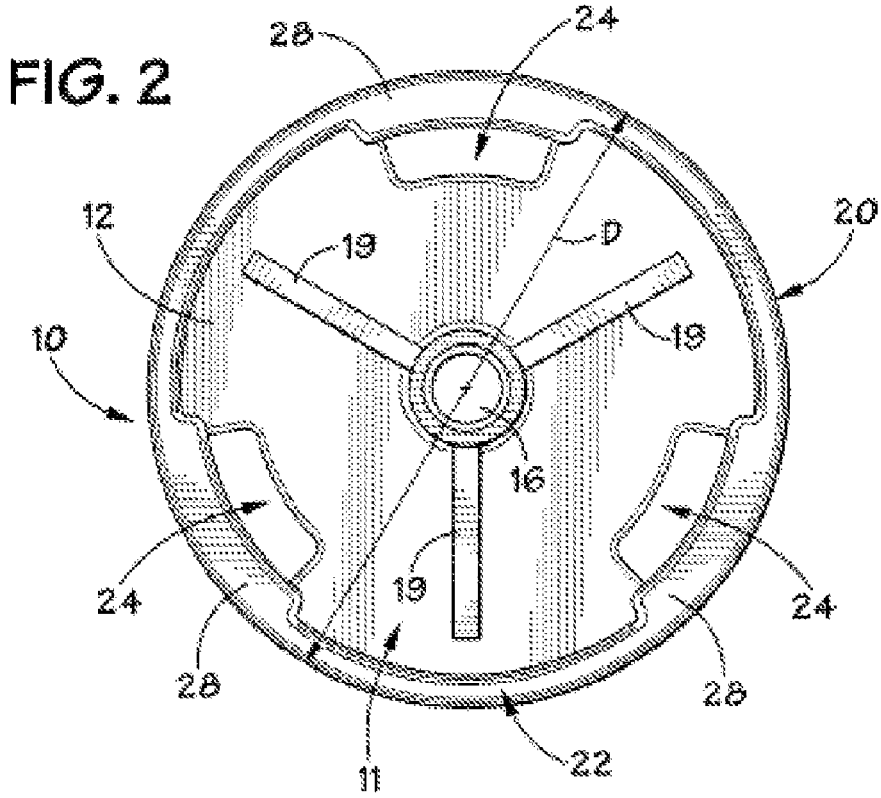

WEIGHT PLATE FOR INTERLOCKING AND WEIGHT ADJUSTMENT

CROSS-REFERENCE TO RELATED APPLICATIONS

This is a continuation of co-pending U.S. patent application Ser. No. 11/083,426, filed Mar. 18, 2005, to which priority is claimed and which is incorporated herein by reference in its entirety.

FIELD OF THE DISCLOSURE

The present disclosure relates generally to physical fitness equipment, and more specifically to an improved weight plate that may be used during weight lifting.

BACKGROUND OF THE DISCLOSURE

Free weight exercises generally require weight plates for use with barbells or dumbbells. The weight plates are typically disc-shaped and include a central opening for receiving a barbell or dumbbell bar through the central opening. One major problem with free weight lifting and a cause of many accidental injuries is that it is difficult to pick up a weight plate, particularly disc-shaped plates having substantially flat sides. Most users can typically handle the lighter weights of 5 or 10 pounds without too much difficulty. But as the size and weight of the weight plate increases, one must be very careful to avoid injury. The problem, simply stated, is that a flat sided weight plate does not have a convenient hand hold to be grasped by the user for lifting it off of a flat surface, such as the floor or a stack of adjacent weight plates. Lifting a typical weight plate off of a flat surface requires that the user apply sufficient radial and frictional force on the periphery or outer perimeter of the disc-shaped plate to lift at least one side of the plate a sufficient distance off the flat surface to permit the user to place at least a portion of his fingers around the periphery and onto one side of the plate. Of course, the heavier the weight plate, the more difficult this lifting maneuver becomes. Lifting a weight plate according to the generally accepted method described above can cause injury if the weight plate slips out of the grasp of the user and falls on his or her toes or fingers.

Some weight plates include an upstanding circumferential flange about the periphery of the plate. This provides a raised surface that may be gripped by the user for lifting the weight plate. The same problems are encountered, however, when an individual attempts to lift the weight plate by its circumferential flange. A sufficient radial and frictional force must still be applied to lift the plate on its peripheral edge so that the user can grip the plate by wrapping his or her fingers and thumb about the upstanding flange and outer edge of the plate.

The problems noted above are not encountered solely when exercising with free weights. Many exercise apparatus require the weight plates be added or removed to vary the resistance provided by the exercise apparatus. The typical weight plate is not only difficult to lift off a flat surface, as noted above, but is also difficult to hold and raise up, perhaps to chest level, to mount the weight plate on an exercise apparatus. Likewise, removing a weight plate from a relatively high position on an exercise apparatus is also difficult and, if not done with care, may result in injury to the individual removing the weight plate.

Yet another constraint on the design of weight plates is control of manufacturing costs. Intricate plate designs typically cost more to manufacture than a standard weight plate, thus creating a unit cost that the market is unwilling to bear. What is needed is a simple solution to the above noted problems that also minimizes manufacturing costs. The weight plate of the present disclosure satisfies this need.

SUMMARY OF THE DISCLOSURE

A weight plate having integrally formed handles is provided. The weight plate has a weight plate body having an outer periphery, a first side, and a second side that is substantially flat. The weight plate also has a central bore extending axially through the body, a raised flange member forming a portion of the outer periphery on the first side, and at least one handle opening extending axially through the body and radially through at least a portion of the outer periphery. Each handle opening in cooperation with the raised flange member define a handle sufficient for a human hand to grip. Where multiple handle openings are employed, including two or more handle openings, the handle openings are equiangularly spaced apart. Additionally, each handle opening includes edge surfaces which are rounded to improve the comfort of the user. In one embodiment, the weight plate further includes an interlock for interlocking the weight plate with another weight plate when positioned together. In another embodiment, the weight plate further includes a pock defined in the weight plate. The pock allows the weight of the weight plate to be adjusted to a desired weight by allowing additional material to be added to the pock.

BRIEF DESCRIPTION OF THE DRAWINGS

A more complete understanding of the present disclosure may be obtained with reference to the accompanying drawings:

FIG. 1 is a perspective view of the first side of an illustrative embodiment of the present disclosure.

FIG. 2 is a plan view of the first side of the illustrative embodiment of the present disclosure.

DESCRIPTION OF ILLUSTRATIVE EMBODIMENTS

The present disclosure will now be described more fully with reference to the accompanying drawings in which a preferred embodiment of the disclosure is shown. This disclosure may, however, be embodied in many different forms and should not be construed as being limited to the embodiment set forth herein.

Figure 3:
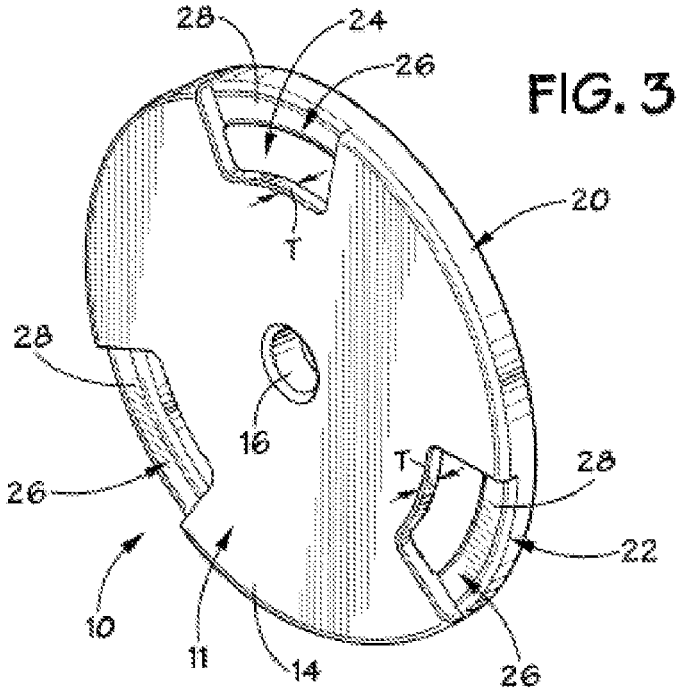
FIG. 3 is a perspective view of the second side of the illustrative embodiment of the present disclosure.
Figure 4:
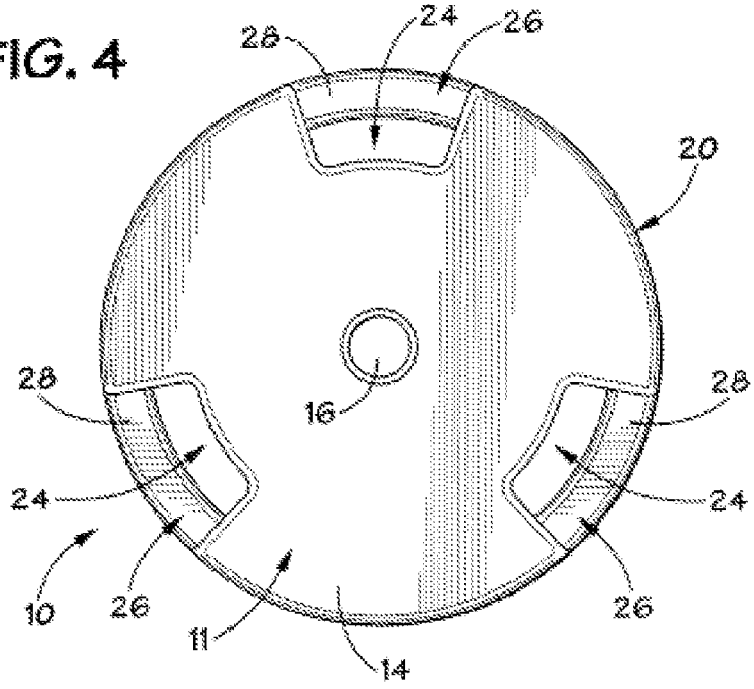
FIG. 4 is a plan view of the second side of the illustrative embodiment of the present disclosure.
Figure 5:
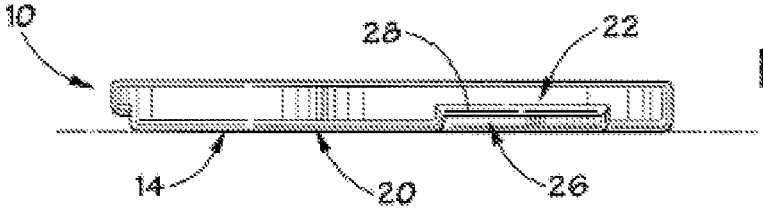
FIG. 5 is a side view of the illustrative embodiment of the present disclosure.

Referring to FIGS. 1-5, a weight plate 10 in accordance with certain teachings of the present disclosure is shown. Weight plate 10 may be cast, rubber coated, and/or polyurethane coated. Weight plate 10 includes a substantially flat body 11 defined by a first planar surface or side 12 and a second planar surface or side 14. The planar surfaces 12, 14 are generally opposed and define the axial thickness T of weight plate 10. FIGS. 1 and 2 depict the first side of weight plate 10, while FIGS. 3 and 4 depict the second side of weight plate 10. A centrally located bore 16 defines the rotational axis of plate 10 and is adapted to receive a mounting member (not shown), such as a barbell or a dumbbell bar.

The bore 16 is further defined by an integrally formed collar 18 which projects outwardly from the first planar surface 12 and adds axial length to bore 16. Support ribs 19 may also be used to provide further support for collar 18. It is understood that the diameter of bore 16 may vary to accommodate various diameter sizes of mounting members to be received through bore 16, and will generally vary between 1 to 2 inches to accommodate most standard bars.

The opposed planar surfaces or sides 12, 14 terminate at an outer periphery 20 of plate body 11. Although FIGS. 1-5 show a substantially circular outer periphery, any periphery shape may also be used, including any polygonal-shaped. The first side of weight plate 10 also includes a flange member 22 integrally formed therewith and forming a portion of the outer periphery 20 that extends outwardly from the first planar surface 12.

In the weight plate 10 shown in FIGS. 1-5, weight plate 10 includes three handle openings 24 formed in the plate body 11 and extending at least partially to the outer periphery 20. Although the FIGS. 1-5 show three handle openings 24, any number of equiangularly spaced handle openings, including but not limited to, two or more handle openings, may be used. The handle openings 24 are disposed extending through body 11 and through at least a portion of the outer periphery 20 (best illustrated in FIGS. 3-5). Although the size of these handle openings 24 may vary depending on the size, weight, and other design particulars of a specific weight plate, each handle opening should be less than about 20%, and more preferably less than about 10%, of the total area of the weight plate body plate, which is calculated as the area of each opening extending through plate body 11 as a percentage of the area of the plate body 11. For clarity, the area of plate body 11 if the plate were circular as shown in FIGS. 1-5 would be simply $\pi*D^2/4$, where D is the diameter of plate body 11. For non-circular plates, the total area of the plate body is would be calculated in an analogous manner.

A recess 26 having a defined axial thickness is formed between each handle opening 24 and the adjacent raised flange member 22. Each recess 26 in conjunction with the corresponding handle opening 24 and the raised flange member 22 form a handle 28 that is dimensioned in such a way that is sufficient for a human hand to grip. For example, handle 28, opening 24, and recess 26 may be sized to receive at least a portion of one or more fingers of a human hand extending therethrough. The axial thickness of recess 26 may be controlled by many means known in the art, including but not limited to increasing or decreasing the size of the flange member 22 at the locations corresponding to handle openings 24. Recess 26 may be of any axial thickness, but is preferably less than about one inch, and more preferably less than about 0.5 inch.

Sharp edges may be eliminated by rounding the edges of the handle openings 24. Likewise, the raised flange member 22 may be rounded to avoid scratching or gouging the floor or harming the user in the event that the weight plate 10 is brushed against the user's body. The handles 28 can be reinforced by reinforcements (not shown) formed on the first side 12 and on each side of the handle openings 24.

One of ordinary skill should appreciate that the handle 28 may be grasped in several ways, including but not limited to: (1) placing one or more fingers through recess 26 first, then wrapping the fingers about handle 28 through opening 24 while wrapping the thumb around the outer periphery 20 to secure the grip, or (2) placing one or more fingers through opening 24 first, then wrapping the fingers about handle 28 through recess 26 while wrapping the thumb around the outer periphery 20 to secure the grip.

Another aspect of the present disclosure is the substantially flat nature of second surface 14 of the weight plate 10. Accordingly, manufacturing costs are reduced by providing a second surface 14 that is substantially flat and contains no integral features that would be difficult or expensive to mill. No support collar or support ribs are required as with first surface 12. No flange member is required on the second side since the handles 28 are formed using the first flange member 22. It will be apparent to one of skill in the art that what is described herein is a novel weight plate having integrally formed handles.

The substantially flat second surface or side 14 offers significant advantages for manufacturing the disclosed weight plates 10. For example, the second side 14 does not require expensive tooling or molds. The substantially flat second side 14 also allows the weight of the initially manufactured weight plate 10 to be adjusted by using any convenient technique for removing plate material from the flat side 14 of the weight plate 10. For example, the flat side 14 of the weight plate 10 can be filed or milled to reduce the weight of the weight plate 10 in small or large increments. This type of filing or milling can be performed before applying any coating, cover, rubberization, or other finish (not shown) to the weight plate 10. Of course, with attention to the finishing type and filing or milling technique used, the finishing can also be applied prior to any filing or milling.

Therefore, with respect to the disclosed weight plate 10, the following manufacturing technique can be used to make a more precisely weighted plate 10. A weight plate 10 can be formed by casting, molding, or other manufacturing technique. The weight plate 10 will have one flat side 14 as disclosed, thereby reducing the difficulty or producing such a plate 10. Furthermore, depending upon the technique to be used for removing plate material from the flat side 14, the formation of the "flat" side 14 need not necessarily be precisely flat. Rather, the side 14 can be approximately or relatively flat and thereby allow for less expensive manufacturing techniques. Furthermore, the target manufacturing weight for the initial step of manufacturing the weight plate 10 can be heavier than the target weight for the finally manufactured weight plate 10. At some point after the creation of the initial "flat" sided weight plate 10, a plate reduction process can be employed to reduce plate material from the "flat" side 14. For example, the "flat" side 14 of the weight plate 10 can be filed or milled to reach an ultimate target weight with greater accuracy. This plate reduction process can also serve to reduce or eliminate defects on the "flat" side 14 of the weight plate 10, if the initial manufacturing technique yielded less than ideal results on the "flat" side 14 (e.g., if the flat side 14 was not quite flat).

Reducing the flat side 14 of the weight plate 10 by filing or milling can be performed in one or more increments in between weighing steps. Alternatively, the weight plate 10 can be weighed during the weigh reduction steps. In the former case, reduction can be performed in time or weight (or mass) increments between weighing. In the later case, the reduction technique can simply be stopped when the weight plate 10 reaches the target weight (or a desired weight in view of any coating or finishing that may be applied later to the plate).

Figure 6A:
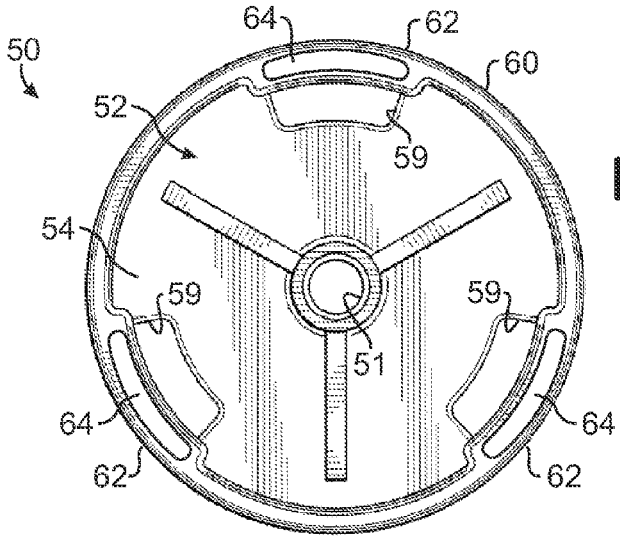
FIGS. 6A-6C illustrate an embodiment of an interlocking weight plate according to certain teachings of the present disclosure.
Figure 6B:
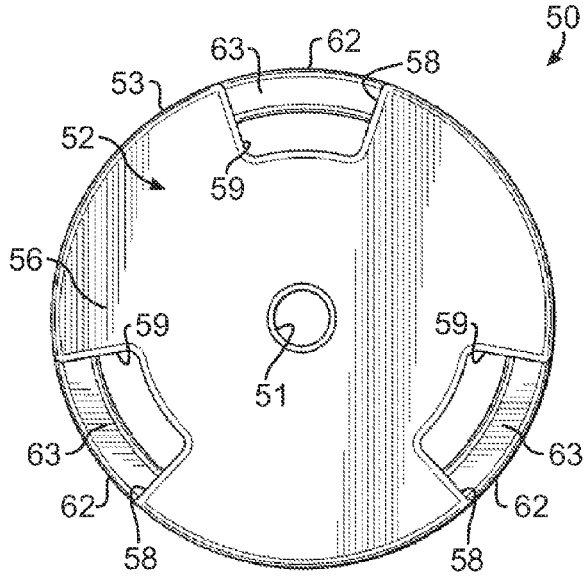
Figure 6C:
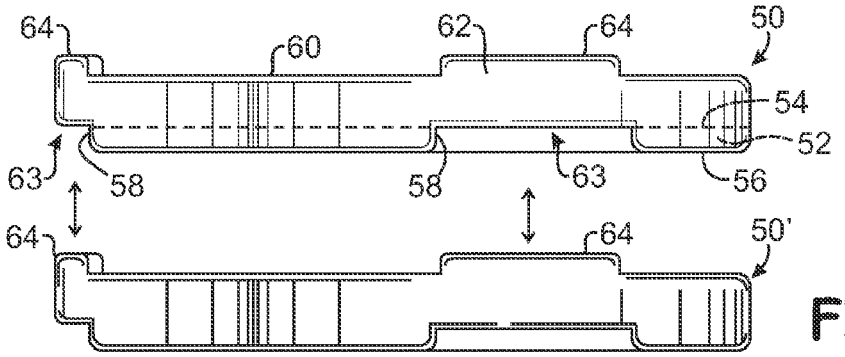

Referring to FIGS. 6A-6C, an embodiment interlocking weight plate 50 according to certain teachings of the present disclosure is illustrated. The weight plate 50 has a plate body 52 having a first side 54 and a second side 56. The plate body 52 defines a central bore 51 for mounting on a bar and defines at least one cutaway 58 in a periphery 53 of the plate body 52. In the present embodiment, the plate body 52 has three cutaways 58 defined at the periphery 53. The second side 56 of the plate body 52 is substantially flat such that material can be removed from the second side 56 of the plate body 52 to adjust weight of the weight plate 50 according to the techniques disclosed herein. For example, the material is removable from the second side 56 of the plate body 52 by milling or filing at least a portion of the substantially flat second side 52 of the plate body 52.

The weight plate 50 also includes a raised lip 60 formed about the periphery 53 of the plate body 52 and formed on the first side 54 of the plate body 52. As best shown in FIG. 6B, portions 62 of the raised lip 60 extend across the cutaways 58 defined in the plate body 52 such that recesses 63 are formed from the second side 56 of the plate body 52. As best shown in FIG. 6A, interlocks 64 are positioned on the raised lip 60 and protrude beyond the raised lip 60. The protruding interlocks 64 can be formed on the portions 62 of the raised lip 60 that extend across the cutaways 58, although this is not strictly necessary as the interlocks can be positioned elsewhere on the raised lip 60. As best shown in FIG. 6C, the interlocks 64 of one weight plate 50' are capable of positioning in the recesses 63 formed in another weight plate 50 when the weight plates 50 and 50' are positioned together.

As shown in FIGS. 6A-6B, the cutaway 58 can define an open portion 59 in the plate body 52 that extends toward the interior of the plate body 52. This open portion 59 can accommodate the hand of a person to hold the weight plate 50. In this regard, the portions 62 of the raised lip 60 extending across the cutaways 58 in the plate body 52 form handles for a person to handle the weight plate 50 in a manner similar to previous embodiments disclosed herein.

Figure 7A:
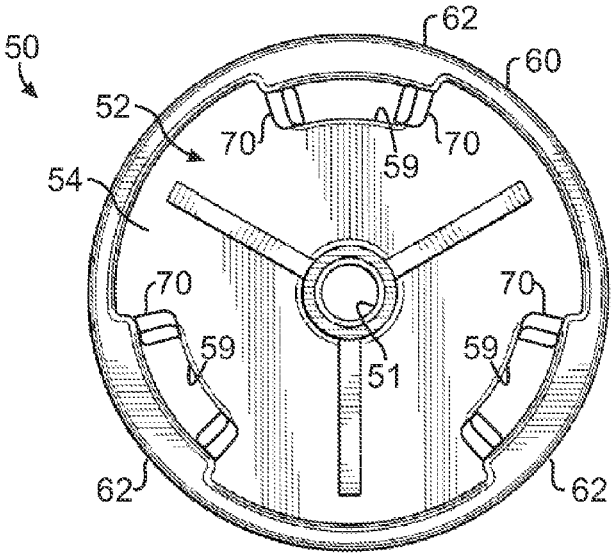
FIGS. 7A-7C illustrate another embodiment of an interlocking weight plate according to certain teachings of the present disclosure.
Figure 7B:
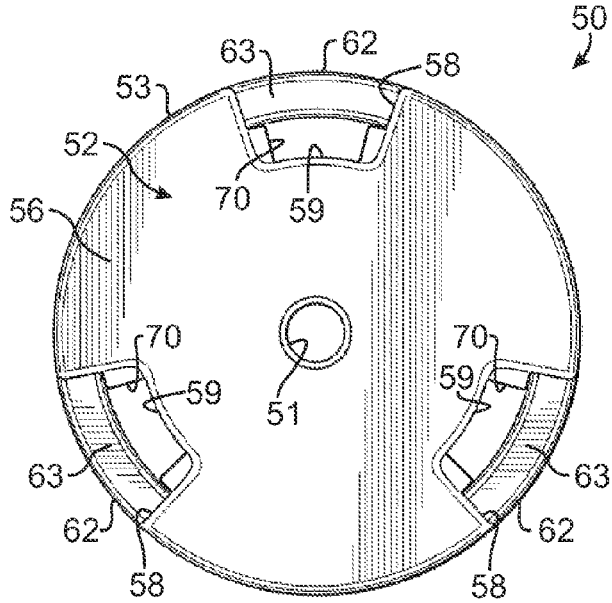
Figure 7C:
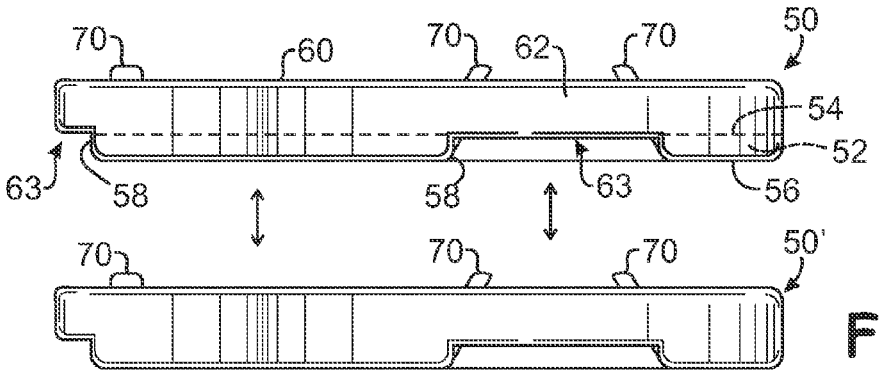

Referring to FIGS. 7A-7B, another embodiment of an interlocking weight plate 50 according to certain teachings of the present disclosure is illustrated. The weight plate 50 is substantially similar to those disclosed in previous embodiments. The weight plate 50 has interlocks 70 formed adjacent the open portions 59 of the cutaways 58 defined in the plate body 52. The interlocks 70 are pairs of protrusions that extend away from the first side 54 of the plate body 52 and that slant inward toward the open portions 59 of the cutaways 58. The size and position of the slanted protruding interlocks 70 preferably still allows a person to use the open portions 59 and handle portions 62 to pick up the weight plate 50. As best shown in FIG. 7C, portions of the slanted protruding interlocks 70 extend beyond the raised lip 60 of the weight plate 50. When similar weight plates 50 and 50' are positioned together, first sides of the slanted protruding interlocks 70 on one weight plate 50' are capable of fitting against second sides of the interlocks 70 on the other weight plate 50.

Figure 8A:
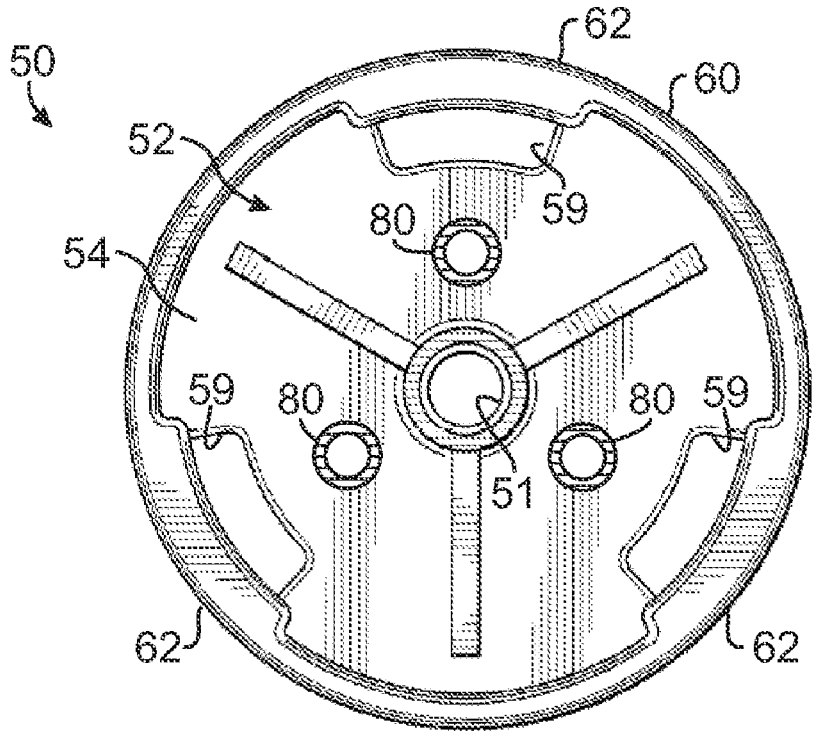
FIGS. 8A-8B illustrate an embodiment of a weight plate having pocks according to certain teachings of the present disclosure.
Figure 8B:
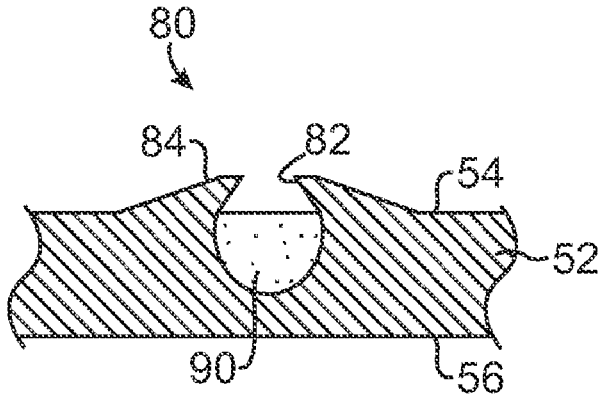

Referring to FIGS. 8A-8B, another embodiment of a weight plate 50 according to certain teachings of the present disclosure is illustrated. Again, the weight plate 50 of FIGS. 8A-8B is substantially similar to those disclosed in previous embodiments with the exception that the weight plate 50 in the present embodiment has a plurality of pocks 80 for adjusting the weight of the weight plate 50. As best shown in the plan view of FIG. 8A, the weight plate 50 has a plurality of pocks 80 formed in the plate body 52. Although three pocks 80 are shown in the present embodiment, it will be appreciated that more or fewer pocks 80 can be provided.

As best shown in FIG. 8B, the pocks 80 are pockets or holes defined in the material of the weight plate 50. Preferably, the pocks 80 are formed with an opening 82 in the first side 54 of the plate body 52. Sides 84 of the pocks 80 may or may not extend beyond the first side 54. Preferably, the pocks 80 are formed during the casting of the weight plate 50, but they can also be formed by machining the weight plate 50 after casting. Should the weight plate 50 exceed a desired weight after casting, the raised sides 84 of the pocks 80 can be milled or filed down to reduce the resultant weight of the cast weight plate 50 to the desired weight.

The pocks 80 can also receive and hold additional material 90 therein to add weight to the weight plate 50 in the event that the cast weight plate 50 does not initially meet a desired weight. The additional material 90 can be any suitable material that can be filled into the pocks 80 to add additional weight. Examples of suitable materials 90 include packed sand, malleable metals (such as lead), steel pellets, or various aggregate materials. Various techniques can be used to hold the additional material 90 into the pocks 80. In the case of a malleable metal or like material, simply packing the pock 80 with the material 90 may be sufficient to keep the material 90 in the pock 80. For aggregate materials 90, such as steel pellets or the like, the material can be positioned in the pocks 80, and the pocks 80 can be filled with thermoplastic or other resin to keep the aggregate material 90 in the pocks 80. Alternatively, coatings or coverings (not shown) may be used to cover the opening 82 of the pock 80 and thereby keep aggregate material 90 in the pock. In another alternative, an additional plate or cover (not shown) can be affixed to the weight plate 50 to cover the pock 80 and keep the aggregate material 90 therein.

While the disclosure has been described with references to specific preferred embodiments, it is not limited to these embodiments. For example, aspects of the various embodiments can be interchanged with one another. Thus, the disclosure may be modified or varied in many ways and such modifications and variations as would be obvious to one of skill in the art are within the scope and spirit of the disclosure and are included within the scope of the following claims.

What is claimed is:

1. A weight plate, comprising:

a plate body having first and second sides and defining a central opening therethrough, the second side being substantially flat, the plate body defining a handle opening through the plate body;

a raised lip positioned on the first side and about a periphery of the plate body, a portion of the raised lip adjacent the handle opening forming a handle on the weight plate, an interlock recess defined behind the handle on the second side of the plate body, the interlock recess having first and second stop edges; and at least one interlock protrusion positioned on the raised lip and protruding away from the first side of the plate body, the at least one interlock protrusion having first and second terminal ends, the first and second terminal ends being engageable with first and second stop edges of another interlock recess defined in another weight plate to prevent substantial rotation of the weight plates relative to one another when positioned together.

2. The weight plate of claim 1, wherein the at least one interlock protrusion is disposed on top of the handle and is substantially aligned with the interlock recess defined behind the handle.

3. The weight plate of claim 1, wherein the plate body defines a plurality of the handle openings such that a plurality of portions of the raised lip form handles for the weight plate.

4. The weight plate of claim 3, wherein the weight plate comprises a plurality of the interlock protrusions positioned on the raised lip and a plurality of interlock recesses defined behind the handles, the interlock protrusions being engageable with interlock recesses defined in the other weight plate to prevent substantial rotation of the weight plates relative to one another when positioned together.

5. The weight plate of claim 1, further comprising a pock defined in the plate body and being capable of receiving additional material to adjust a weight of the weight plate.

6. The weight plate of claim 1, wherein the substantially flat second side comprises a machineable surface from which material is removable to adjust a weight of the weight plate.

7. A weight plate, comprising:

a plate body having first and second sides, the second side being substantially flat, the plate body defining a central opening and at least one peripheral opening therethrough, the peripheral opening having opposing side edges in the plate body;

a raised lip positioned on the first side and about a periphery of the plate body; and at least one interlock positioned on the first side of the plate body adjacent the at least one peripheral opening and extending from the first side of the plate body beyond the raised lip, a portion of the at least one interlock being engageable with at least one opposing side edge of another peripheral opening defined in another weight plate to prevent substantial rotation of the weight plates relative to one another when positioned together.

8. The weight plate of claim 7, wherein the at least one interlock comprises a pair of protrusions positioned on the first side of the plate body adjacent the opposing side edges of the at least one peripheral opening, portions of each of the pair of protrusions being engageable with one of the opposing side edges of the other peripheral opening defined in the other weight plate to prevent substantial rotation of the weight plates relative to one another when positioned together.

9. The weight plate of claim 8, wherein each of the pair of protrusions is slanted inward toward the at least one peripheral opening such that a first side of each of the protrusions engages with a second side of another of the protrusions on the other weight plate when the weight plates are positioned together.

10. The weight plate of claim 7, wherein a portion of the raised lip adjacent the at least one peripheral opening forms a handle for the weight plate.

11. The weight plate of claim 10, wherein the plate body defines a plurality of the peripheral openings such that a plurality of portions of the raised lip form handles for the weight plate.

12. The weight plate of claim 7, wherein the weight plate comprises a plurality of the interlocks and defines a plurality of the peripheral openings, the interlocks engageable with peripheral openings defined in the other weight plate to prevent substantial rotation of the weight plates relative to one another when positioned together.

13. The weight plate of claim 7, further comprising a pock defined in the plate body and being capable of receiving additional material to adjust a weight of the weight plate.

14. The weight plate of claim 7, wherein the substantially flat second side comprises a machineable surface from which material is removable to adjust a weight of the weight plate.

15. A weight plate, comprising:

a plate body having first and second sides and defining a central opening therethrough, the second side being substantially flat and defining at least one cutaway in the second side at a periphery of the plate body, the at least one cutaway having first and second stop edges on the second side of the plate body at the periphery;

a raised lip positioned on the first side and about the periphery of the plate body; and at least one interlock extending beyond the raised lip on the first side of the weight plate and having first and second terminal ends, the terminal ends of the at least one interlock being engageable with first and second stop edges of another cutaway defined in another weight plate to prevent substantial rotation of the weight plates relative to one another when positioned together.

16. The weight plate of claim 15, wherein the at least one interlock comprises at least one protrusion positioned on the raised lip, the at least one protrusion having the terminal ends engageable with the stop edges of the other cutaway defined in the other weight plate to prevent substantial rotation of the weight plates relative to one another when positioned together.

17. The weight plate of claim 15, wherein the at least one interlock comprises a pair of protrusions positioned on the first side of the plate body adjacent the opposing stop edges of the at least one cutaway and extending from the first side of the plate body beyond the raised lip, portions of the pair of protrusions engageable with opposing stop edges of the other cutaway defined in the other weight plate to prevent substantial rotation of the weight plates relative to one another when positioned together.

18. The weight plate of claim 15, wherein the at least one cutaway defines a handle opening through the weight plate adjacent the raised lip at the periphery, and wherein a portion of the raised lip adjacent the handle opening forms a handle for the weight plate.

19. The weight plate of claim 18, wherein the raised lip has a first inner face facing the central opening, the first inner face having a first inner radius about the central opening, and wherein the handle has a second inner face facing the central opening, the second inner face having a second inner radius about the central opening, the second inner radius being less than the first radius of the raised lip.

20. The weight plate of claim 10, wherein the raised lip has at least one handle portion positioned across the at least one cutaway, the at least one handle portion and the at least one cutaway forming at least one grippable handle on the weight plate.

21. The weight plate of claim 1, wherein mere positioning of the at least one interlock protrusion in the interlock recess enables engagement between the terminal ends of the at least one interlock and the stop edges of the interlock recess.

22. The weight plate of claim 7, wherein mere positioning of the at least one interlock adjacent the peripheral opening enables engagement between the portion of the at least one interlock and the at least one opposing side edge of the peripheral opening.

23. The weight plate of claim 15, wherein mere positioning of the at least one interlock in the cutaway enables engagement between the terminal ends of the at least one interlock and the stop edges of the cutaway.

* * * * *